US010227715B2

(12) United States Patent
Gang

(10) Patent No.: US 10,227,715 B2
(45) Date of Patent: Mar. 12, 2019

(54) MANUFACTURING METHOD OF REFRIGERANT FABRIC AND REFRIGERANT FABRIC MANUFACTURED BY THE METHOD

(71) Applicant: SEJONG TF Inc., Seoul (KR)

(72) Inventor: Seok Man Gang, Gyeongsan-si (KR)

(73) Assignee: SEJONG TF INC., Seoul (KR)

( * ) Notice: Subject to any disclaimer, the term of this patent is extended or adjusted under 35 U.S.C. 154(b) by 0 days.

(21) Appl. No.: 15/718,083

(22) Filed: Sep. 28, 2017

(65) Prior Publication Data

US 2018/0100265 A1 Apr. 12, 2018

(30) Foreign Application Priority Data

Oct. 7, 2016 (KR) ..... 10-2016-0129450

(51) Int. Cl.

| | |
|---|---|
| ***D03D 15/00*** | (2006.01) |
| ***D03D 1/00*** | (2006.01) |
| ***D03D 13/00*** | (2006.01) |
| ***D03D 15/08*** | (2006.01) |

(52) U.S. Cl.

CPC ..... *D03D 15/00* (2013.01); *D03D 1/00* (2013.01); *D03D 13/00* (2013.01); *D03D 15/08* (2013.01); *D03D 2700/0133* (2013.01); *D10B 2401/04* (2013.01)

(58) Field of Classification Search

CPC ..... D03D 15/00; D03D 13/00; D03D 1/00; D03D 2700/0133; D10B 2401/04

See application file for complete search history.

(56) References Cited

U.S. PATENT DOCUMENTS

| | | | | | |
|---|---|---|---|---|---|
| 3,128,528 | A * | 4/1964 | Magel | D06M 14/16 | 28/155 |
| 3,373,774 | A * | 3/1968 | Cruz | D02G 1/205 | 139/420 R |
| 3,788,365 | A * | 1/1974 | Campbell, Sr. | A41F 9/02 | 139/421 |
| 3,965,943 | A * | 6/1976 | Goff, Jr. | A41F 9/02 | 139/421 |

FOREIGN PATENT DOCUMENTS

| | | | |
|---|---|---|---|
| GB | 2277939 | * | 11/1994 |
| KR | 1020090063412 | A | 6/2009 |
| KR | 101332240 | B1 | 11/2013 |

* cited by examiner

*Primary Examiner* — Andrew W Sutton

(74) *Attorney, Agent, or Firm* — STIP Law Group, LLC

(57) ABSTRACT

The invention relates to a method of manufacturing a refrigerant fabric using warps and wefts in which Z-twist yarns and S-twist yarns are arranged at a ratio of 1:1 in the warps and the wefts and the refrigerant fabric manufactured by the method. The method includes: a Z-twist yarn manufacturing step of manufacturing Z-twist yarns with Z-twist using fibers; a S-twist yarn manufacturing step of manufacturing S-twist yarns with S-twist using fibers; a warp arrangement step of alternating the manufactured Z-twist yarns and S-twist yarns and arranging them as warps; a weft arrangement step alternating the manufactured Z-twist yarns and S-twist yarns and arranging them as wefts; and a fabric weaving step of weaving a fabric using the arranged warps and wefts.

3 Claims, 7 Drawing Sheets

FIG. 3

KATRI Korea Apparel Testing and Research Institute

5th floor, National Pension Corporation
Daegu Bldg.
419, Seongjeo-ro, Dalseo-gu, Daegu
(Daegok-dong)
T: +82-53-525-1932~4 F: +82-53-525-4968
www.katri.kr Electronic signature of the director

Test report

Applicant: Sejong TF Co., Ltd.
Address: 4th Floor, 284-14, Oksu-dong, Seongdong-gu, Seoul Submitted to:
Name of sample: 2 Pieces of Fabric
Sample 1: 8407D, Sample 2: 52035

KATRI NO: DGAA 16-00004477
Date of receipt: June 24, 2016
Date of issuance: June 30, 2016
Use: For quality control
PAGE(S): 1 of 8

| Test item | Test result | |
|---|---|---|
| | Sample 1 | Sample 2 |
| Measurement of cooling effect (J/cm²/s): KES-F7 (Thermo Labo II) | | |
| QMAX | 0.188 | 0.205 |
| ▷ Remarks to note<br>1. Test equipment: KES-F7 (Thermo Labo II)<br>2. Test environment<br>1) Temperature: (20±2)℃<br>2) Humidity: (65±2)℃ %R.H.<br>3. Temperature difference between thermometer and specimen: 10℃ | | |
| Electron microscope photograph: FE-SEM | Attached | Attached |
| * Note) 1. Test equipment: Field emission scanning electron microscope<br>2. Attachment: Electron microscope photograph (image) | | |

-Continue-

Director of the Korea Apparel Testing and Research Institute

Note: 1. This test report shows the result of testing the samples under the sample names provided by the applicant and does not guarantee the quality of the product.
2. This test report cannot be used for promotion, propaganda, advertisement and litigation without prior written consent of the examiner in charge and is prohibited to use for purposes other than the designated purpose.

MANUFACTURING METHOD OF REFRIGERANT FABRIC AND REFRIGERANT FABRIC MANUFACTURED BY THE METHOD

CROSS-REFERENCE TO RELATED APPLICATIONS

This application clams the priority of the Korean Patent Applications No. 10-2016-0129450 on Oct. 7, 2016 in the Korean Intellectual Property Office, the disclosure of which is incorporated herein by reference.

BACKGROUND OF THE INVENTION

Field of the Invention

The present invention relates to a method of manufacturing a refrigerant fabric and a refrigerant fabric manufactured by the method. More specifically, the present invention relates to a method of manufacturing a refrigerant fabric using warps in which Z-twist yarns and S-twist yarns are arranged at a ratio of 1:1 and wefts in which Z-twist yarns and S-twist yarns are arranged at a ratio of 1:1, and a refrigerant fabric manufactured by the method.

Description of the Related Art

In recent years, a plurality of functional fabrics having additional features such as an antibacterial function, a cooling and heating function, a thermal function, and a heat dissipation function has been developed. In particular, technologies capable of allowing peoples to feel coolth and warmth appropriately according to the outside temperature by adding cold and warm treatment agent to the fabric.

Such a cold and warm treatment agent serves to keep the body temperature warm during a low outside temperature and lower the body temperature appropriately during a high outside temperature.

The typical refrigerant is manufactured by imparting the refrigerant property to a yarn and weaving it. Korean Patent Registration No. 10-1332240 discloses a method for manufacturing a refrigerant fabric.

The technique includes a dyeing step of dyeing a fabric containing a polyester based fabric in a salt bath in which a dispersion dye and glacial acetic acid are contained, followed by dehydration; a refrigerant property imparting step of coating a refrigerant agent on the fabric, which has been dyed in the dyeing step, by dipping the dyed fabric in an aqueous solution of a refrigerant agent and a binder, the refrigerant agent containing xylitol, erythritol, or both xylitol and erythritol; a reductive cleansing step of removing a dye attached to a surface of the fabric; and a post-treatment step of performing a cire process to the fabric.

In case of the method for imparting the refrigerant property to the yarn, since the processing cost of the yarn is high and the manufacturing process is complicated, there is a defect in that the final yarn price is increased.

On the other hand, Korean Patent Publication No. 10-2009-0063412, which is a technology of complexly applying the left twisted yarn and the right twisted yarn, discloses a weaving method of pure cotton and textile using the same.

In the above technique, it prepares hard-twist yarns with the number of twist of 1300~2000 TPM through the twisted yarn process and the weaving process; has weft and warp with a twist direction of Z-twist yarns (left twist) and S-twist yarns (right twist); and weaves the left yarn/weft with arrangement structure of 1:1 or 2:2.

That is, one of the weft and the warp, which are a yarn used for cotton yarn weaving is twisted in the direction of S-twist yarns (right twisted yarn) and the other is twisted in the direction of Z-twist yarns (left twisted yarn).

However, in the above technique, since the cotton yarn is used, it lacks elasticity. Also, since the right twisted yarn and the left twisted yarn are arranged on any one selected from the weft and the warp, there is a problem in that it cannot be manufactured densely so as to increase the refrigerant property through the security of space between fabrics. Moreover, since the cotton yarn is used, there is a problem in that it is inappropriate to use as outdoor fabrics having refrigerant property.

Patent Literature

Patent Literature 1: Korean Patent Registration No. 10-1332240B1 (Nov. 18, 2013)

Patent Literature 2: Korean Patent Publication No. 10-2009-0063412A (Jun. 18, 2009)

SUMMARY OF THE INVENTION

The present invention has been made to solve the problems occurring in the prior art, and an object thereof is to provide a method of manufacturing a refrigerant fabric using warps and wefts in which Z-twist yarns and S-twist yarns are arranged at a ratio of 1:1 respectively, thereby enhancing a cooling effect and lowering the manufacturing cost of the fabric.

Another object of the present invention is to provide a method of manufacturing a refrigerant fabric capable of manufacturing fabrics having smooth texture while maintaining elasticity appropriate for leisure activities through a yarn processing.

According to an aspect of the invention to achieve the object described above, there is provided a method of manufacturing a refrigerant fabric, including: a Z-twist yarn manufacturing step of manufacturing Z-twist yarns with Z-twist using fibers; a S-twist yarn manufacturing step of manufacturing S-twist yarns with S-twist using fibers; a warp arrangement step of alternating the thus manufactured Z-twist yarns and S-twist yarns and arranging them as warps; a weft arrangement step alternating the thus manufactured Z-twist yarns and S-twist yarns and arranging them as wefts; and a fabric weaving step of weaving a fabric using the arranged warps and wefts.

Preferably, the fiber is a covering yarn manufactured by covering a filament yarn consisting of 20 to 30 filament strands and having 65 to 75 denier on an elastic yarn of 38 to 42 denier as the core yarn.

Preferably, the Z-twist yarns and the S-twist yarns are alternated in the ration of 1:1.

BRIEF DESCRIPTION OF THE DRAWINGS

The above and other objects, features and advantages of the present invention will be more apparent from the following detailed description taken in conjunction with the accompanying drawings, in which:

FIG. 3 is a test report of a refrigerant fabric manufactured by the method of manufacturing a refrigerant fabric according to the present invention;

DETAILED DESCRIPTION OF THE PREFERRED EMBODIMENT

Hereinafter, preferred embodiments of the invention will be described in more detail with reference to the accompanying drawings.

The present invention relates to a method of manufacturing a refrigerant fabric woven using warps in which Z-twist yarns and S-twist yarns are arranged at a ratio of 1:1 and wefts in which Z-twist yarns and S-twist yarns are arranged at a ratio of 1:1, and a refrigerant fabric manufactured by the method.

Figure 1:
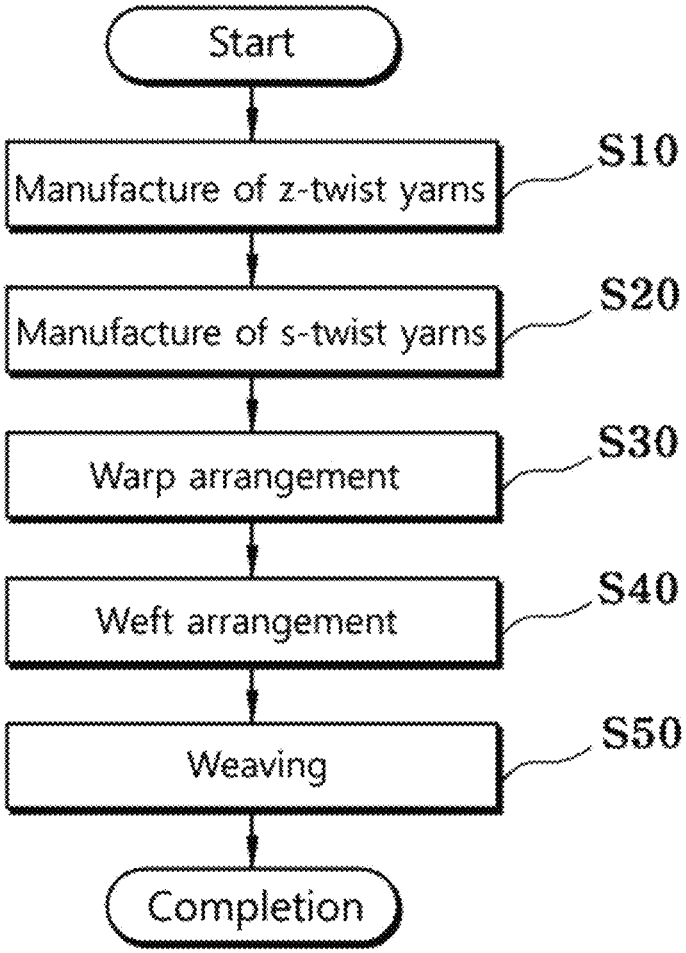
FIG. 1 is a flowchart of a method of manufacturing a refrigerant fabric according to the present invention.

FIG. 1 is a flowchart of a method of manufacturing a refrigerant fabric according to the present invention.

With reference to FIG. 1, the method of manufacturing a refrigerant fabric according to the present invention comprises: a Z-twist yarn manufacturing step (S10), a S-twist yarn manufacturing step (S20), a warp arrangement step (S30), a weft arrangement step (S40) and a fabric weaving step (S50).

1. Z-Twist Yarn Manufacturing Step (S10)

The Z-twist yarn manufacturing step (S10) is a step of manufacturing a Z-twist yarn with Z-twist using fibers. In the Z-twist yarn, the direction of the twist is from the right top to the left bottom. This twist is referred to as Z-twist.

Here, the Z-twist yarn may have the number of twists per meter ranging from 740 to 760 TM (Twist per meter), preferably 750 TM.

Here, TM refers to the number of twists per meter, and the properties of a fiber vary significantly depending on the number of the twists.

When fibers are twisted, all the points of the fibers exert a force toward the center, and the adjacent fibers press against each other. The friction between the fibers due to this pressure prevents the fibers from slipping and gives strength to the fibers.

When the number of twists increases to obtain the highest strength, the twist is called a saturated twist. When the number of twists is more than that, the strain increases, resulting in a decrease in the strength. As the number of twists increases, the thickness of the fiber becomes thinner while the fiber becomes harder and more difficult to deform, resulting in an increase in the void ratio of warp/weft. On the contrary, as the number of twists decreases, the fiber becomes soft and swells, thus becoming thick in appearance and having smaller gaps. In addition, when the number of twists is small, the gloss is high, but as the number of twists increases, the cross section of the yarn becomes close to a circle, and the gloss decreases.

A yarn with many twists is called a hard twisted yarn. When twisted, threads are inclined to resist the twist and return to the original state. When further twisted, threads are inclined to contract.

The fiber used in the fabrication of common fabrics is any one selected from a Z-twist yarn and an S-twist yarn and has the number of twists of 500 to 600 TM.

2. S-Twist Yarn Manufacturing Step (S20)

The S-twist yarn manufacturing step (S20) is a step of manufacturing a S-twist yarn with S-twist using fibers. In the S-twist yarn, the direction of the twist is from the left top to the right bottom. This twist is referred to as S-twist.

Like the Z-twist yarn, the S-twist yarn may have the number of twists per meter ranging from 740 to 760 TM (Twist per meter), preferably 750 TM.

The Z-twist yarn manufactured by the Z-twist yarn manufacturing step (S10) and the S-twist yarn manufactured by the S-twist yarn manufacturing step (S20) may have the final number of twists per meter of 750 TM (Twist per meter) after Z-twisting and S-twisting, respectively. However, the number of twists may be varied to further enhance the cooling effect.

Here, the fiber may be configured as a covering yarn.

The covering yarn is manufactured by covering a filament yarn on an elastic yarn as the core yarn. The elastic yarn may consist of a spandex or polyurethane (rubber) yarn, and the filament yarn may consist of one or more selected from nylon, polyester and acrylic yarns.

Specifically, the elastic yarn may consist of a rubber yarn of 38 to 42 denier, preferably a rubber yarn of 40 denier. Here, the filament yarn may be covered on the rubber yarn after the rubber yarn is stretched three times its original length.

Here, the filament yarn may consist of 20 to 30 filament strands and have a total thickness of 65 to 75 denier. More specifically, it may consist of 24 filament strands and have a thickness of 70 denier.

For example, if an elastic yarn of 40 denier is stretched three times its original length, the thickness of the yarn becomes 13.33 denier. If 24 filament yarns each having a thickness of 2.92 denier (70 denier/24) are covered on the stretched 13.33 denier yarn, the total thickness of the final fiber becomes 83.33 denier.

In addition, a steaming process may be further performed after the twisting to achieve 740 to 760 TM.

The steaming process prevents contraction of twist yarns. It is a process of stabilizing the shape of the product by thermally treating the fibers.

As described above, the fiber according to the present invention is not manufactured by a general method, but by covering a filament yarn on a rubber yarn as the core yarn along with twisting to achieve 740 to 760 (specifically 750) TM. Thus, it achieves an enhanced strength and durability even without chemical treatment, and obtains an increased bulky feel to maintain a soft touch and enhance a cooling effect.

3. Warp Arrangement Step (S30)

The warp arrangement step (S30) is a step of alternating the Z-twist yarns and the S-twist yarns manufactured above and arranging them as warps.

4. Weft Arrangement Step (S40)

The weft arrangement step (S40) is a step of alternating the Z-twist yarns and the S-twist yarns manufactured above and arranging them as wefts.

In the above steps, the ratio of the Z-twist yarns and the S-twist yarns arranged at the warp arrangement step (S30) and the ratio of the Z-twist yarns and the S-twist yarns arranged at the weft arrangement step (S40) may be 1:1.

5. Fabric Weaving Step (S50)

The fabric weaving step (S50) is a step of weaving a fabric using the arranged warps and wefts. The weaving may be performed using a general weaving machine.

Figure 2:
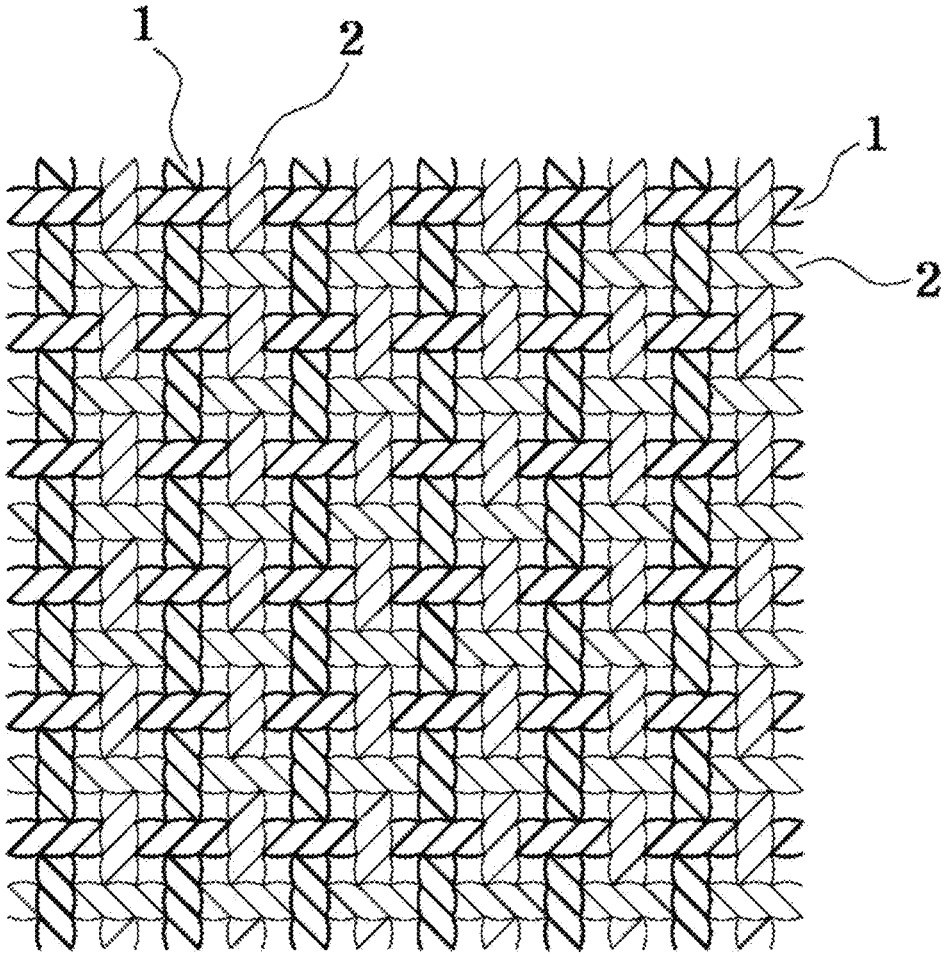
FIG. 2 is a surface view of a refrigerant fabric manufactured by the method of manufacturing a refrigerant fabric according to the present invention.

FIG. 2 is a surface view of a refrigerant fabric manufactured by the method of manufacturing a refrigerant fabric according to the present invention.

With reference to FIG. 2, a Z-twist yarn 2 is arranged on the right and left of an S-twist yarn 1. Likewise, an S-twist yarn 1 is arranged on the right and left of a Z-twist yarn 2. Each of warp and weft, arranged as a Z-twist yarn and an S-twist yarn, is woven so as to cross each other at a right angle.

FIG. 3 is a test report of a refrigerant fabric manufactured by the method of manufacturing a refrigerant fabric according to the present invention.

With reference to FIG. 3, in the test of the cooling effect of a fabric with a general cooling effect (sample 1) and a refrigerant fabric manufactured according to the present invention (sample 2), the fabric with a general cooling effect exhibited a cooling effect of 0.188 ($J/cm^2/S$), while the refrigerant fabric manufactured according to the present invention exhibited a cooling effect of 0.205 ($J/cm^2/S$). The result shows that the fabric manufactured by the manufacturing method of the present invention is superior in cooling effect to a fabric with a general cooling effect.

Figure 4A:
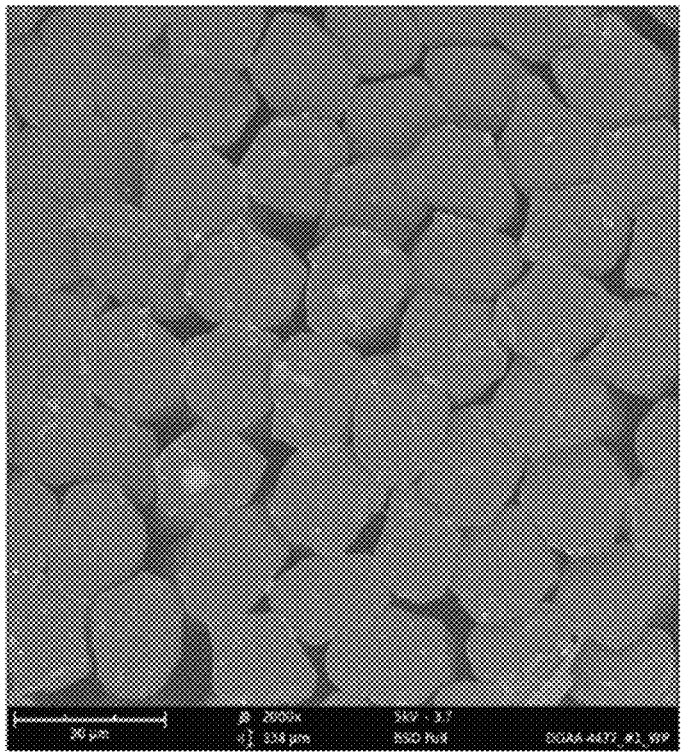
FIGS. 4(*a*) and 4(*b*) are cross-sectional photographs substituted for drawing of the warps and wefts of a fabric having a general cooling effect.
Figure 4B:
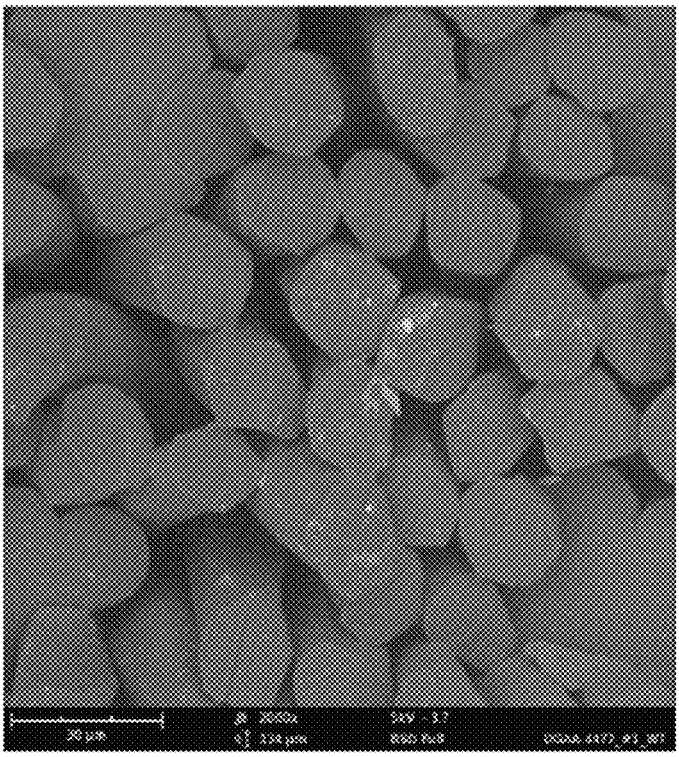
Figure 5A:
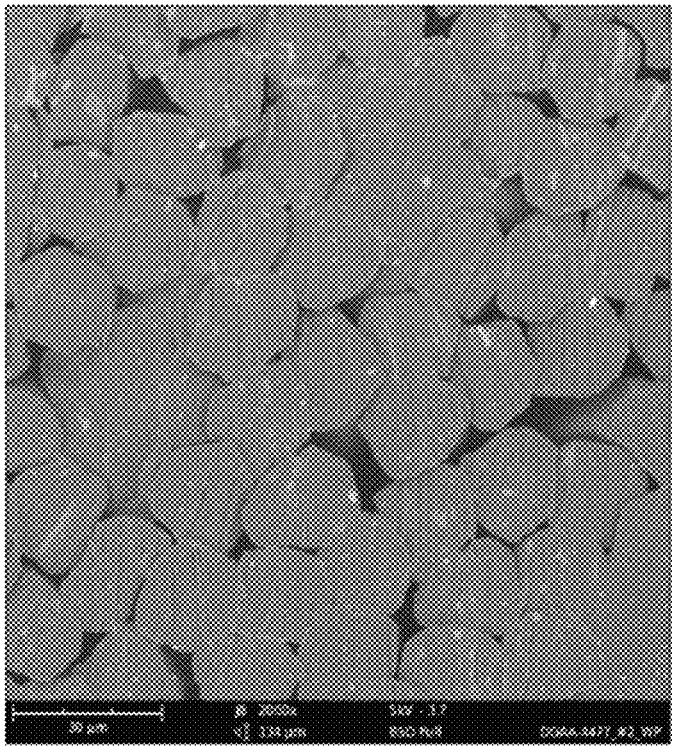
FIGS. 5(*a*) and 5(*b*) are cross-sectional photographs substituted for drawing of the warps and wefts of a fabric manufactured according to the present invention.
Figure 5B:
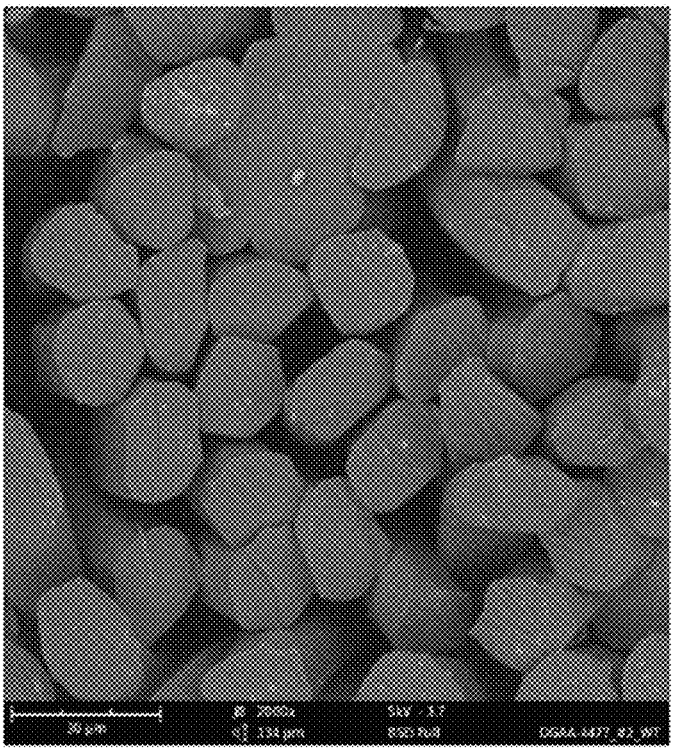

FIGS. 4(*a*) and 4(*b*) are cross-sectional photographs substituted for drawing of the warps and wefts of a fabric having a general cooling effect, and FIGS. 5(*a*) and 5(*b*) are cross-sectional photographs substituted for drawing of the warps and wefts of a fabric manufactured according to the present invention.

With reference to FIGS. 5(*a*) and 5(*b*), the gaps in the cross-sectional photographs of the warps (FIG. 5(*a*)) and the wefts (FIG. 5(*b*)) of the fabric according to the present invention are relatively larger than the gaps in the cross-sectional photographs of the warps (FIG. 4(*a*)) and the wefts (FIG. 4(*b*)) of the fabric with a general cooling effect.

Figure 6:
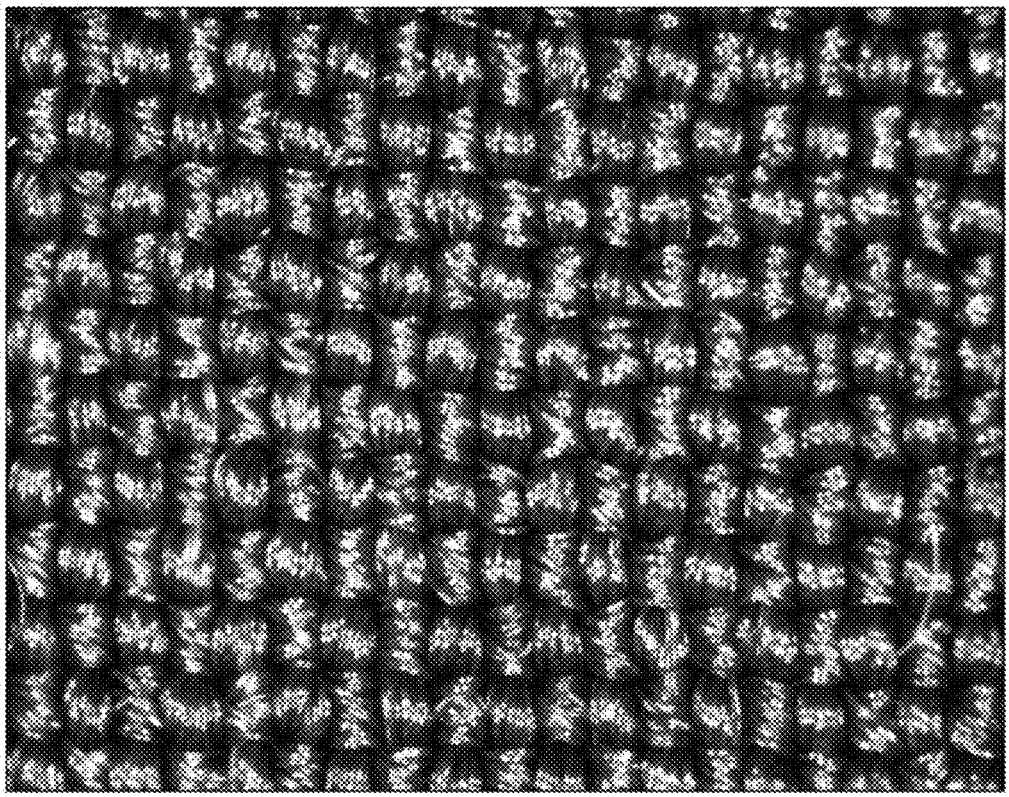
FIG. 6 is a surface photograph substituted for drawing of a fabric having a general cooling effect.
Figure 7:
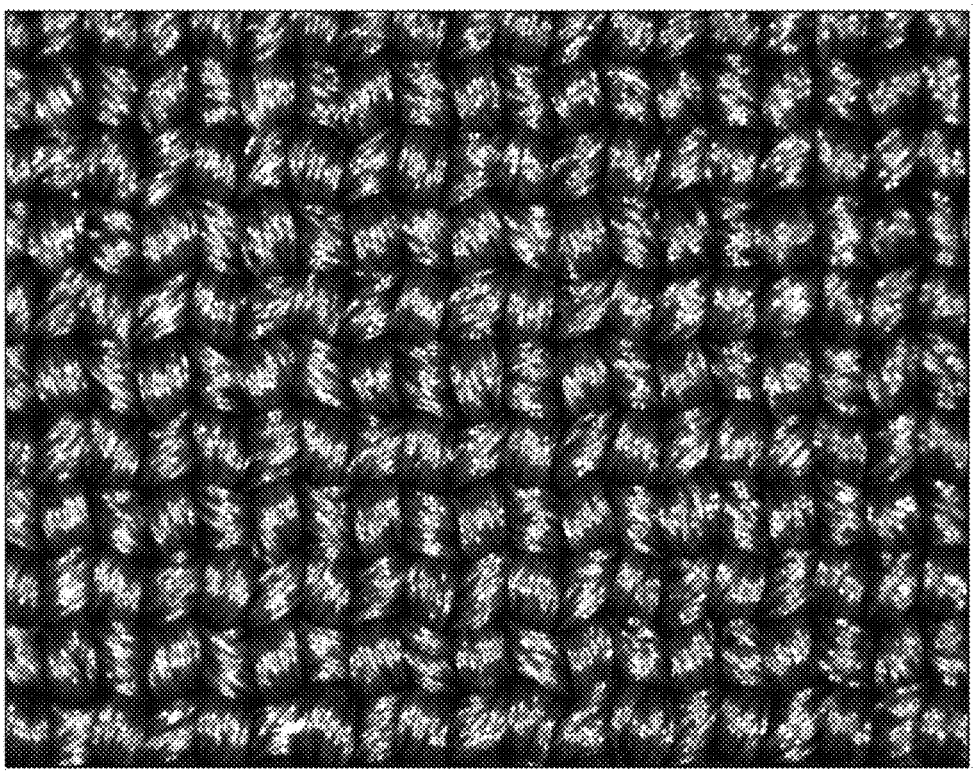
FIG. 7 is surface photograph substituted for drawing of a fabric manufactured according to the present invention.

FIG. 6 is a surface photograph substituted for drawing of a fabric having a general cooling effect, and FIG. 7 is surface photograph substituted for drawing of a fabric manufactured according to the present invention.

With reference to FIG. 7, it can be seen that the gaps in the surface photograph of the fabric according to the present invention are relatively larger than the gaps of the fabric having a general cooling effect (see FIG. 6).

That is, the fabric according to the present invention has relatively large gaps as compared with general fabrics with a cooling effect, and thus has an increased pneumaticity (percentage of included air), thus achieving enhanced ventilation. It can also prevent the body temperature from rising because it allows the body temperature generated in the human body to be easily released to the outside.

In addition, as Z-twist yarns and S-twist yarns are arranged at a ratio of 1:1, the contact surface between the skin and the fabric decreases, thus improving the cooling effect.

Further, the fiber according to the present invention is loosened after strong twisting, in order to maintain a predetermined number of twists, so that the soft touch of the fiber itself can be maintained, and the fabric woven using it is excellent in elasticity and thus is suitable for outdoor leisure applications.

According to the present invention, a fabric is woven using warps and wefts, in which Z-twist yarns and S-twist yarns are alternated, which increases the space between the fibers, resulting in an increase in the pneumaticity, and leads to an excellent air permeability, thus enhancing a cooling effect.

In addition, the fabric is excellent not only in elasticity, but also in tensile strength, frictional strength and tear strength by virtue of twisting. It also has an advantage of reduction of the fabric manufacturing cost.

While the present invention has been described with respect to the specific embodiments, it will be apparent to those skilled in the art that various changes and modifications may be made without departing from the spirit and scope of the invention as defined in the following claims.

What is claimed is:

1. A method of manufacturing a refrigerant fabric, comprising:

a Z-twist yarn manufacturing step of manufacturing Z-twist yarns with Z-twist using fibers;

a S-twist yarn manufacturing step of manufacturing S-twist yarns with S-twist using fibers;

a warp arrangement step of alternating the manufactured Z-twist yarns and S-twist yarns and arranging them as warps;

a weft arrangement step alternating the manufactured Z-twist yarns and S-twist yarns and arranging them as wefts; and a fabric weaving step of weaving a fabric using the arranged warps and wefts, wherein each of the fibers is a covering yarn consisting of a core yarn covered by a filament yarn, the core yarn is an elastic yarn having 38 to 42 denier, the filament yarn consists of 20 to 30 filament strands, and the filament strands have 65 to 75 denier.

2. The method of manufacturing a refrigerant fabric according to claim 1, wherein the Z-twist yarns and the S-twist yarns are alternated at a ratio of 1:1.

3. A refrigerant fabric manufactured by the method of claim 1.

* * * * *